US009751721B1

(12) United States Patent
Hernandez

(10) Patent No.: US 9,751,721 B1
(45) Date of Patent: Sep. 5, 2017

(54) CORE FOR WINDING ELASTOMERIC YARNS

(71) Applicant: Sonoco Development, Inc., Hartsville, SC (US)

(72) Inventor: Ismael Antonio Hernandez, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 15/240,353

(22) Filed: Aug. 18, 2016

(51) Int. Cl.
*B65H 75/10* (2006.01)

(52) U.S. Cl.
CPC ..... *B65H 75/10* (2013.01); *B65H 2701/319* (2013.01); *B65H 2701/5112* (2013.01)

(58) Field of Classification Search
CPC ..... B65H 75/10; B65H 2701/511; B65H 2701/5112; B65H 2701/319; B31C 11/04
See application file for complete search history.

(56) References Cited

U.S. PATENT DOCUMENTS

| | | | |
|---|---|---|---|
| 2,369,488 | A | 2/1945 | Perry |
| 3,179,536 | A | 4/1965 | Martinek |
| 3,581,744 | A | 6/1971 | Voss et al. |
| 4,371,130 | A | 2/1983 | Case |
| 5,328,121 | A | 7/1994 | Rummage |
| 5,472,154 | A | 12/1995 | Qiu et al. |
| 5,495,087 | A | 2/1996 | Rummage |
| 6,309,717 | B1 | 10/2001 | Qiu et al. |
| 6,595,456 | B2 | 7/2003 | Rummage |
| 7,240,875 | B2 | 7/2007 | Hernandez et al. |
| 2006/0016569 | A1 | 1/2006 | Morin et al. |
| 2009/0218435 | A1 | 9/2009 | Morgan |
| 2010/0326418 | A1 | 12/2010 | Sesock et al. |
| 2011/0057069 | A1 | 3/2011 | Hernandez et al. |
| 2011/0103718 | A1 | 5/2011 | Bosman |
| 2012/0177859 | A1 | 7/2012 | Gavel et al. |
| 2013/0186583 | A1 | 7/2013 | Xia et al. |

FOREIGN PATENT DOCUMENTS

| | | |
|---|---|---|
| CN | 1056912 | 12/1991 |

*Primary Examiner* — William E Dondero
(74) *Attorney, Agent, or Firm* — Alston & Bird LLP

(57) ABSTRACT

A paperboard core is described above that is designed to receive a yarn wound thereon, such as an elastomeric yarn that relies on friction for proper winding of the yarn onto the core. In particular, the core includes a clay-coated paper outer ply which is capable of providing direct frictional engagement of the core with the yarn, such that the yarn is windable on the core via direct contact between the clay-coated outer ply and the yarn. In this way, there is no need to use a film on the outer surface of the core in order to obtain the desired frictional properties that will result in proper winding of the yarn onto the core.

20 Claims, 9 Drawing Sheets

CORE FOR WINDING ELASTOMERIC YARNS

BACKGROUND

The present disclosure relates to paperboard cores for winding elastomeric yarns.

Cores are used in the production of yarn to receive an end of the yarn after it has be spun. The yarn is wound around the core to provide a way for a particular length of the yarn to be packaged, transported, and/or stored until such time that the yarn is used. At that point, the yarn can be unwound from the core for use, such as for making a fabric.

Different yarns have different properties. Elastomeric yarns (such as spandex), for example, are stretchable and have rapid and substantially complete elastic recovery once the force applied to stretch the yarn is removed.

BRIEF SUMMARY

Embodiments of the present invention are directed to cores configured for use in the production of elastomeric yarns. In particular, embodiments of a core with a clay-coated paper outer ply are provided that provide adequate friction between the core surface and the elastomeric yarn to facilitate transfer of the yarn to the core without requiring the application of a separate film on the core's outer surface to promote engagement of the elastomeric yarn with the core. Eliminating the film allows for several advantages in the production of the elastomeric yarns, as described in greater detail below.

Accordingly, embodiments of a paperboard core configured to receive a yarn wound thereon are therefore provided, where the core includes at least one inner ply and an outer ply disposed adjacent to the at least one inner ply. The outer ply comprises clay-coated paper, and the outer ply is configured to provide direct frictional engagement of the core with the yarn, such that the yarn is windable on the core. The yarn may, for example, be an elastomeric yarn.

In some cases, the core may further comprise an ink layer printed on an outer surface of the outer ply. The outer ply may be spirally wound onto the at least one inner ply.

In some embodiments, the core may further comprise an overcoating applied to an outer surface of the outer ply. The overcoating may be configured to act as a barrier against chemicals from the yarn passing into the core when the yarn is wound onto the core. Additionally or alternatively, the overcoating may be configured to enhance the frictional engagement of the core with the yarn. In some cases, the core may further comprise a layer of adhesive between the at least one inner ply and the outer ply. The outer ply may comprise Precipitated Calcium Carbonate (PCC), china clay, latex, or any combination thereof.

In other embodiments, a paperboard core is provided that is configured to receive a yarn wound thereon, wherein the core comprises a clay-coated paper outer ply, wherein the outer ply is configured to provide direct frictional engagement of the core with the yarn, such that the yarn is windable on the core via direct contact between the clay-coated outer ply and the yarn. The core may further comprise a layer of adhesive between at least one inner ply and the outer ply. The outer ply may comprise Precipitated Calcium Carbonate (PCC), china clay, latex, or any combination thereof. In some embodiments, the core may comprise an overcoating applied to an outer surface of the outer ply.

In still other embodiments, a method of making a paperboard core configured to receive a yarn wound thereon is provided, where the method comprises disposing an outer ply adjacent to at least one inner ply, and where the outer ply comprises clay-coated paper. The outer ply is configured to provide direct frictional engagement of the core with the yarn, such that the yarn is windable on the core via direct contact between the clay-coated outer ply and the yarn.

In some cases, disposing the outer ply adjacent to the at least one inner ply comprises spirally winding the outer ply onto the at least one inner ply. The method may further comprise applying an adhesive layer between the at least one inner ply and the outer ply, and/or the method may further comprise applying an overcoating to an outer surface of the outer ply.

In some embodiments, the overcoating may be configured to act as a barrier against chemicals from the yarn passing into the core when the yarn is wound onto the core. Additionally or alternatively, the overcoating may be configured to enhance the frictional engagement of the core with the yarn. The method may further comprise applying an ink layer to an outer surface of the outer ply.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
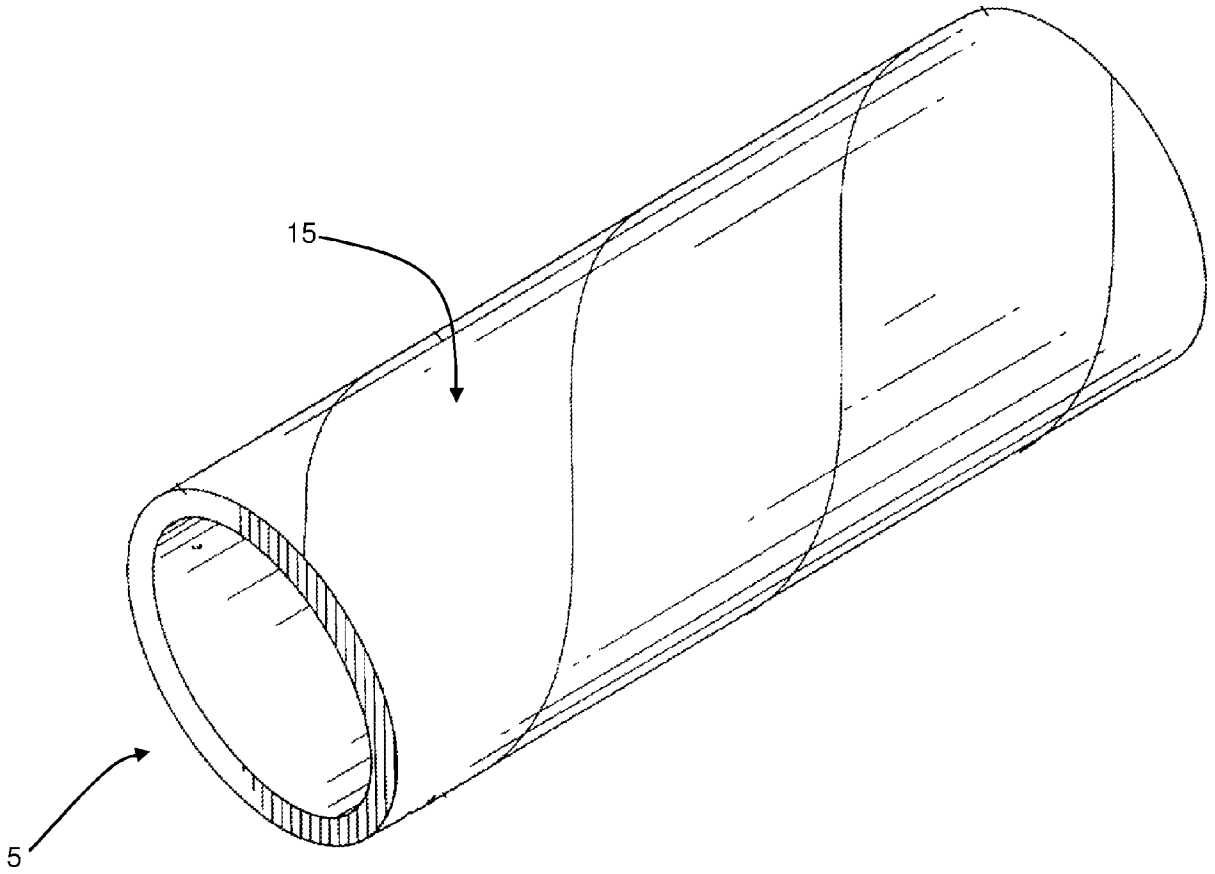
FIG. 1 illustrates a core for the winding of yarn.
Figure 2:
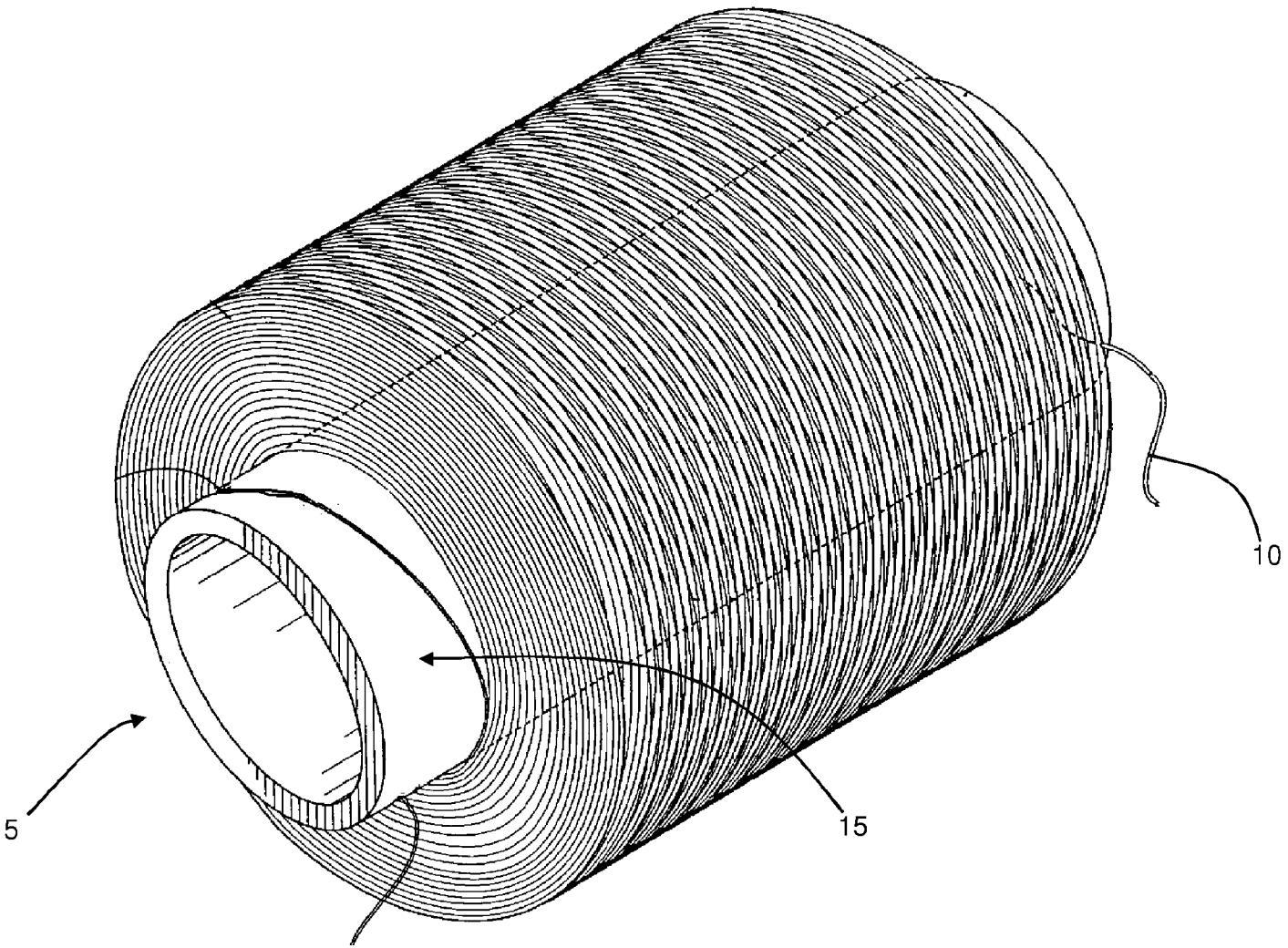
FIG. 2 illustrates the core of FIG. 1 with yarn wound thereon.

Cores, such as the conventional core 5 shown in FIG. 1, are commonly used in the production of yarns, such as elastomeric yarns, to provide a surface about which the yarn may be wound in order to facilitate transport, packaging, storage, and/or downstream handling of the yarn. A conventional core 5 with yarn 10 wound on it is shown in FIG. 2, for example. Depending on the type of yarn involved, the winding process may rely, at least in part, upon friction between an outer surface 15 of the core 5 to enable the transfer of the yarn 10 to the core. In the case of elastomeric yarn, such as spandex, adequate friction between the yarn 10 and the outer surface 15 of the core 5 allows the yarn to be held in place with respect to the core as the core is rotated, such that the yarn can be wound about the core. An insufficient amount of friction, however, may cause the yarn to move or slip with respect to the core's surface, resulting in poor or inefficient winding of the yarn about the core.

In the case of elastomeric yarn, the friction between the yarn and an outer layer of the core that is made of paper or paperboard is typically not sufficient to engage the elastomeric yarn properly during the winding process. Thus, conventional cores generally require the application of a film to the outer surface of the core to create an adequate amount of friction for facilitating yarn transfer, such that the outer surface 15 of the core 5 is the outer surface of the film. A simplified cross-section of a portion of the conventional core 5 depicted in FIG. 1 is shown in FIG. 3.

Figure 3:
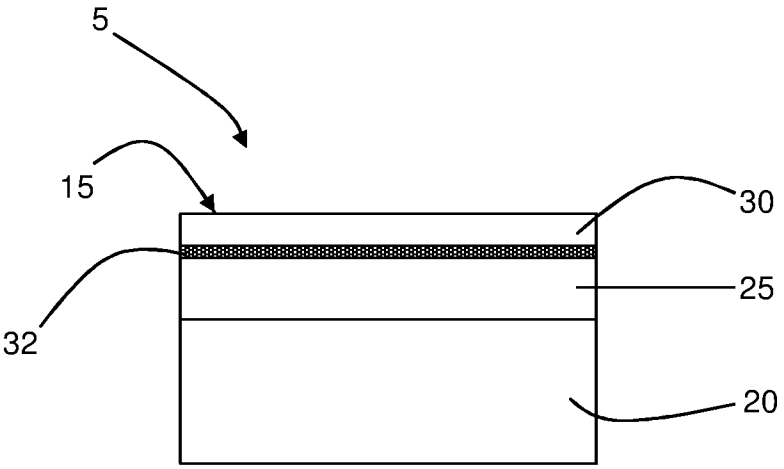
FIG. 3 is a side view of a portion of the core of FIG. 1.

As shown in FIG. 3, a conventional core 5 typically includes inner plies 20, which may be one or more layers of paperboard that provide appropriate strength to the core for supporting the particular yarn that will be wound about the core; an outer layer 25 of paperboard, which in some cases may be the outermost layer of the inner plies 20; and a film layer 30 applied on the outer surface of the outer layer 25 during the winding process (as part of making the conventional core). An outer surface of the film layer 30 thus forms the outer surface 15 of the core 5, such that the friction created between the core and the yarn being wound around the core depends on the material properties of and interaction between the film layer 30 and the yarn. Materials such as cellophane, biaxially-oriented polypropylene (BOPP), polyethylene terephthalate (PET), and polyvinylidene chloride (PVDC), for example, have often been used in films that are applied to the outer surface of an outermost layer 25 of paper or paperboard forming the core 5 to achieve an adequate amount of friction between the elastomeric yarn and the core. The film layer 30 may, for example, be adhered to an outer surface of the outer layer 25 using a specialty adhesive 32. Color markings may be applied to the outer layer 25 (e.g., by applying ink to the outer surface of the outer layer via printing processes) prior to application of the specialty adhesive 32 and the film layer 30 in some cases, such as to identify the type or specifications of the yarn that is wound about the respective core 5.

Use of such films in conventional cores, however, has drawbacks and adds constraints to the core manufacturing process. For example, application of a film to the outermost paper layer of the core can limit the moisture transfer into and out of the core due to the barrier properties of the film. In addition, because the film blocks water penetration into the core, a conventional core having such a film layer is generally harder (and more costly) to recycle. As a result, such conventional cores are more likely to be disposed of in a land fill or incinerated, creating a greater negative effect on the environment than other, more ecological processes of disposal.

Moreover, films used in conventional cores to achieve a desired amount of friction generally shrink at a different rate and to a different degree than the underlying paper portion of the core, causing the edge of the film to obstruct over the end yarn takeoff. Furthermore, yarns wound on cores are often identified via color schemes that are applied to the cores. In cases where a film is required to create sufficient friction, identification via color schemes is necessarily limited to the use of methods that can be completed prior to the application of the film, as the films are generally poor receivers of color indicators (e.g., hard to print on), and the film is applied during the winding process used to make the core. Thus, last minute changes in the type of yarn to be wound on the core would necessitate the use of a different core, as conventional cores are inventoried with the films already applied and would, thus, already have color indicators present, under the film, which cannot be changed despite a change in a customer's order.

In addition, yarns such as elastomeric yarns may have different profiles, different diameters, and different types of coatings. Accordingly, changes in any of these characteristics of the yarn typically affects the optimal friction required for engagement with the core, whereas the friction profile of the core is set and remains constant once the film is applied, being primarily dependent on the material selected for the film.

Figure 4:
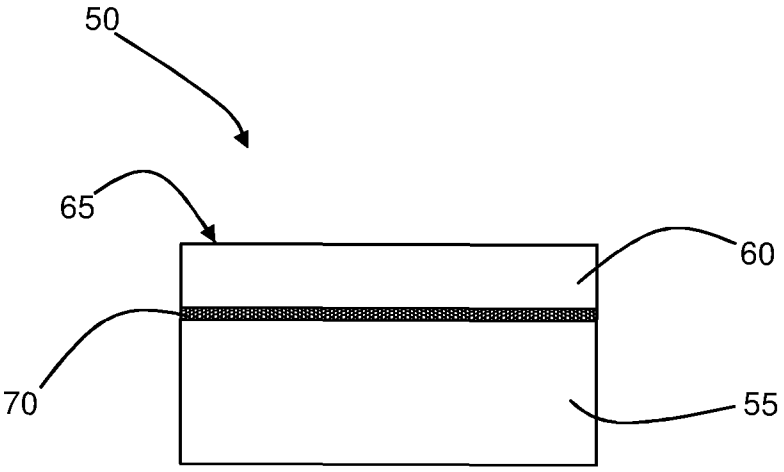
FIG. 4 is a side view of a portion of a core in accordance with an embodiment of the invention.

Accordingly, with reference to FIG. 4, embodiments of the present invention provide a paperboard core 50 that is configured to receive a yarn wound thereon, where the core includes at least one inner ply 55 and an outer ply 60 disposed adjacent to the at least one inner ply. As described in greater detail below, the outer ply 60 comprises clay-coated paper. In this way, the outer ply 60 provides direct frictional engagement of the core 50 with the yarn, such that the yarn is windable on the core without requiring the application of a film layer on the outer ply. Rather, the presence of the clay in the clay-coated paper forming the outer ply 60 creates an adequate amount of friction between the outer ply 60 and the yarn, such that the yarn may be wound onto the core 50 via direct contact between the yarn and the outer surface 65 of the outer ply 60.

In particular, the clay-coated paper forming the outer ply 60 may comprise paper that is coated with a material such as Precipitated Calcium Carbonate (PCC), china clay, latex, and other substances, which can be used in combination or separately. The material used for the coating serves to fill in the tiny concavities and voids between the fibers of the paper. According to conventional wisdom, such coatings improve the opacity, luster, and color-absorption properties of the paper by giving the paper a smooth and flat outer surface. The inventors, however, have discovered that the use of such coatings in the paperboard core 50 described herein surprisingly enhances the frictional properties of the outer surface 65 of the outer ply 60, The inventors note that the friction resulting from the use of clay-coated paper as the outer ply 60 was unexpected, as clay-coated paper grades are conventionally used for applications other than for making cores for winding yarn. For example, conventional clay-coated paper was developed for the printing and graphic display markets to provide gloss, high printability, and improved aesthetics. Beyond web handling, the strength of clay-coated sheets of paper is not a functional requirement in conventional applications. According to conventional knowledge, for example, clay-coated paper and clay coatings provide an extremely smooth and slippery texture, rather than providing a frictionally enhanced surface. Engineered carrier design as discussed herein, on the other hand, requires a maximization of the strength of the paper material as well as a minimization of the cost. For these reasons, clay-coated paper has not been used, nor would it occur to someone skilled in the art to use clay-coated paper, as a surface in an application in which increased friction between the surface and the yarn is necessary for proper winding of the yarn, for example.

In some embodiments, the clay-coated outer ply 60 may be spirally wound onto the at least one inner ply 55. For example, the core 50 may comprise a layer of adhesive 70 that is applied between the at least one inner ply 55 and the outer ply 60 to hold the outer ply to the outer surface of the outermost inner ply. In some cases, for example, a polyvinyl acetate (PVA) adhesive may be used to hold the outer ply 60 in place.

Figure 5:
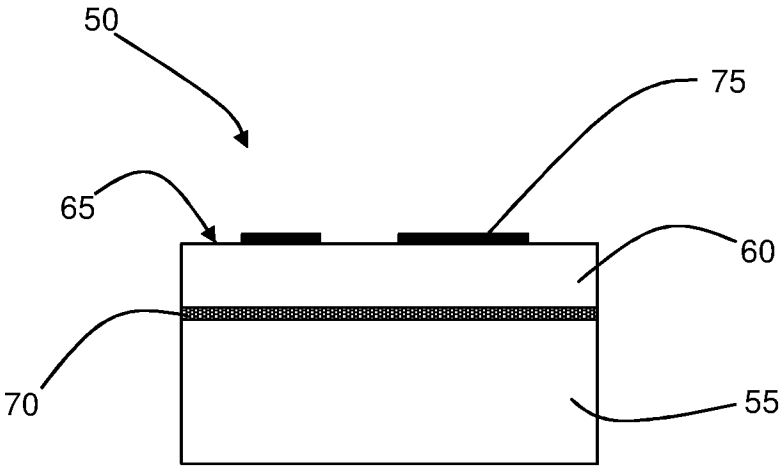
FIG. 5 is a side view of a portion of a core in accordance with an embodiment of the invention including an ink layer.

As noted above, the use of a clay-coated outer ply 60 as described herein eliminates the need for using a film layer as the outermost layer of the core, as the appropriate frictional properties for engaging the yarn (e.g., elastomeric yarn) during the winding process are inherent in the clay-coated outer ply. As such, an ink layer 75 may be printed on the outer surface 65 of the outer ply 60, so as to provide a way to identify the type and/or specifications of the yarn that is wound on the core 50, as shown in FIG. 5. The ink layer 75 may be applied to provide identification of the yarn to be wound on the core, in some cases, as noted above. For example, in some embodiments, the ink layer 75 may provide identifying features in the form of characters (e.g., text codes), color bands (e.g., different colors for different types of yarn), patterns, 2-dimensional bar codes, and/or printed electronics (e.g., when electro-conductive inks are used to print radio frequency identification (RFID) circuits). Moreover, the ink layer 75 may be applied to any portion of the outer surface 65 of the outer ply 60, such as, in some cases, on the ends thereof. For example, color bands may be applied on one or both ends of the outer ply 60 of the core 50, such that after the yarn corresponding to the color is wound on the core, the color bands are still visible to the user and can be used to identify the type of yarn stored on the core. Therefore, regardless of the printing of an ink layer 75 and/or its location on the core, the yarn may still be wound directly onto the outer ply 60 (without the need to apply a film layer overtop the ink layer) due to the frictional properties imparted to the outer ply by the clay-coated paper that is used.

Figure 6:
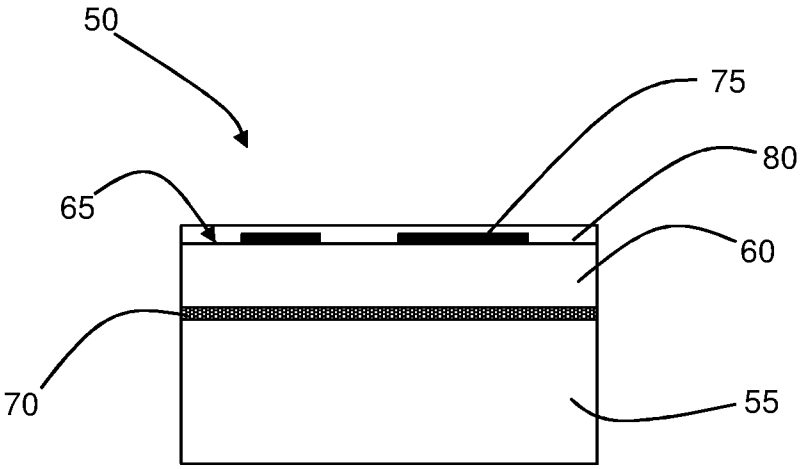
FIG. 6 is a side view of a portion of a core in accordance with an embodiment of the invention including an overcoating.

Although a film layer is not necessary to achieve an adequate level of frictional engagement between the core and the yarn that is wound onto the core when the clay-coated paper is used in the outer layer 60 as described above, in some embodiments the core 50 may further comprise an overcoating 80 that is applied to the outer surface 65 of the outer ply, as shown in FIG. 6. The overcoating 80 may, for example, be an ultraviolet (UV)-curable, thermally-curable, or solvent-based coating, as described in greater detail below. In contrast with a conventional film layer (e.g., a cellophane, biaxially-oriented polypropylene (BOPP), polyethylene terephthalate (PET), or polyvinylidene chloride (PVDC) film layer), the overcoating 80 can be applied to the outer layer 60 of the core at any point after the core 50 is formed, such as after the core is initially inventoried and a request from a customer is received for a particular type of yarn to be supplied. In addition, unlike conventional films 30 that come in pre-determined thicknesses, depending on the type of film (e.g., cellophane vs. PVDC), the overcoating 80 can be applied in any amount to provide a custom thickness as desired (e.g., applying more overcoating to achieve a greater thickness). Thus, in addition to being able to select the material of the overcoating 80, as described below, the user can adjust the thickness of the overcoating that is applied, as well as the coverage area of the overcoating, such as by applying the overcoating in a particular pattern or in only certain areas of the outer surface 65 of the outer ply 60. Such parameters of the overcoating 80 may be selected, for example, to provide a desired amount of friction or to achieve other desired qualities (e.g., for reasons of aesthetics).

In some cases, for example, the overcoating 80 may be configured to further enhance the friction of the outer ply 60 of the core 50. Thus, although adequate friction for the winding process may be provided through the engagement of the yarn directly with the outer ply 60 according to embodiments of the present invention described above, the frictional properties of the outer ply 60 may be further increased through the application of a UV overcoating 80. For example, in some cases, a matte UV coating (e.g., a SunCure® Matte 1741 coating, produced by Sun Chemical of North Lake, Ill.) may be used at a film weight of 0.7-1.0 lbs/1000 $ft^2$, using 200 lines per inch and 10 billion cubic microns/$in^2$ anilox, which may be applied via flexo, roller, or gravure coater. In other cases, however, a satin UV coating (e.g., a SunCure® Satin 1694 coating, produced by Sun Chemical of North Lake, Ill.) may be used at a film weight of 0.5 lbs/1000 $ft^2$, using 200 lines per inch and 10 billion cubic microns/$in^2$ anilox, which may be applied via flexo presses. A satin coating may be selected over a matte coating to impart a more glossy appearance to the outer surface 60 of the core 50. In either case, however, the film weight may be varied as desired to provide an appropriate amount of frictional contact with the yarn. Furthermore, in some embodiments, the coating 80 may be applied in a pattern, rather than covering the entire outer layer 60 of the core 50. Another example of a UV coating that may be used is Inno-Coat UC-HR27A and UC-HR27A from IdeOn LLC of Hillsborough, N.J., which may comprise mixed acrylates, such as monomers and oligomers. Still another UV coating that may be used is a silicone-based UV coating, such as Silcolease UV Poly 206 from Bluestar Silicones USA Corp of York, S.C., which may comprise a mixture of polyorganosiloxanes, fillers, and additives.

In other cases, the coating 80 may be configured to act as a barrier to prevent or reduce the passing of chemicals from the yarn into the core 50 when the yarn is wound onto the core. For example, chemicals may be added to the yarn to facilitate processing of the yarn. When the yarn is wound onto the core 50, these chemicals may contact the core and be absorbed by the core, in some cases damaging the core, obscuring or altering the ink layer 75 on the core, or otherwise impairing the ability of the core to hold the yarn. In this regard, in some embodiments, instead of a UV coating, a thermally cured coating may be used, such as a Serfene™ 2024B coating from Rohm and Haas of Philadelphia, Pa. The thermally cured coating may include polyvinyl chloride copolymer and residual monomers.

In applications where less friction is needed and/or barrier properties are not required, a solvent-based coating may be used for the overcoating 80 rather than a UV- or thermally curable coating. The solvent-based coating may be a clear-coat ink that is applied using ink-jet technology, such as CT-PTG-087-R ink from Code Tech Corporation of Princeton, N.J.

Figure 7A:
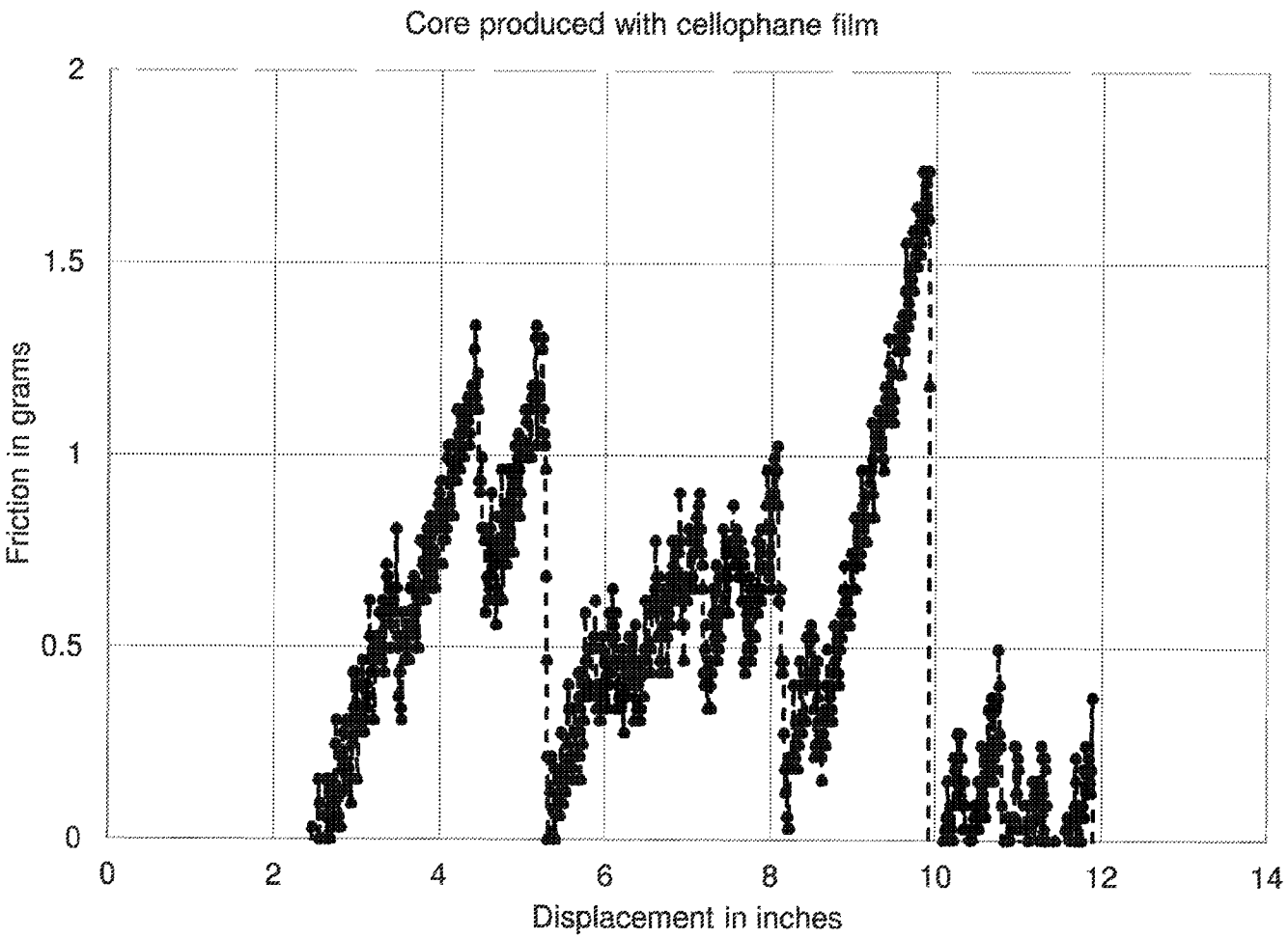
FIGS. 7A-7C illustrate the frictional properties of different configurations of embodiments of the invention, plotting data regarding the friction performance of cores produced with different outer surface treatments.
Figure 7B:
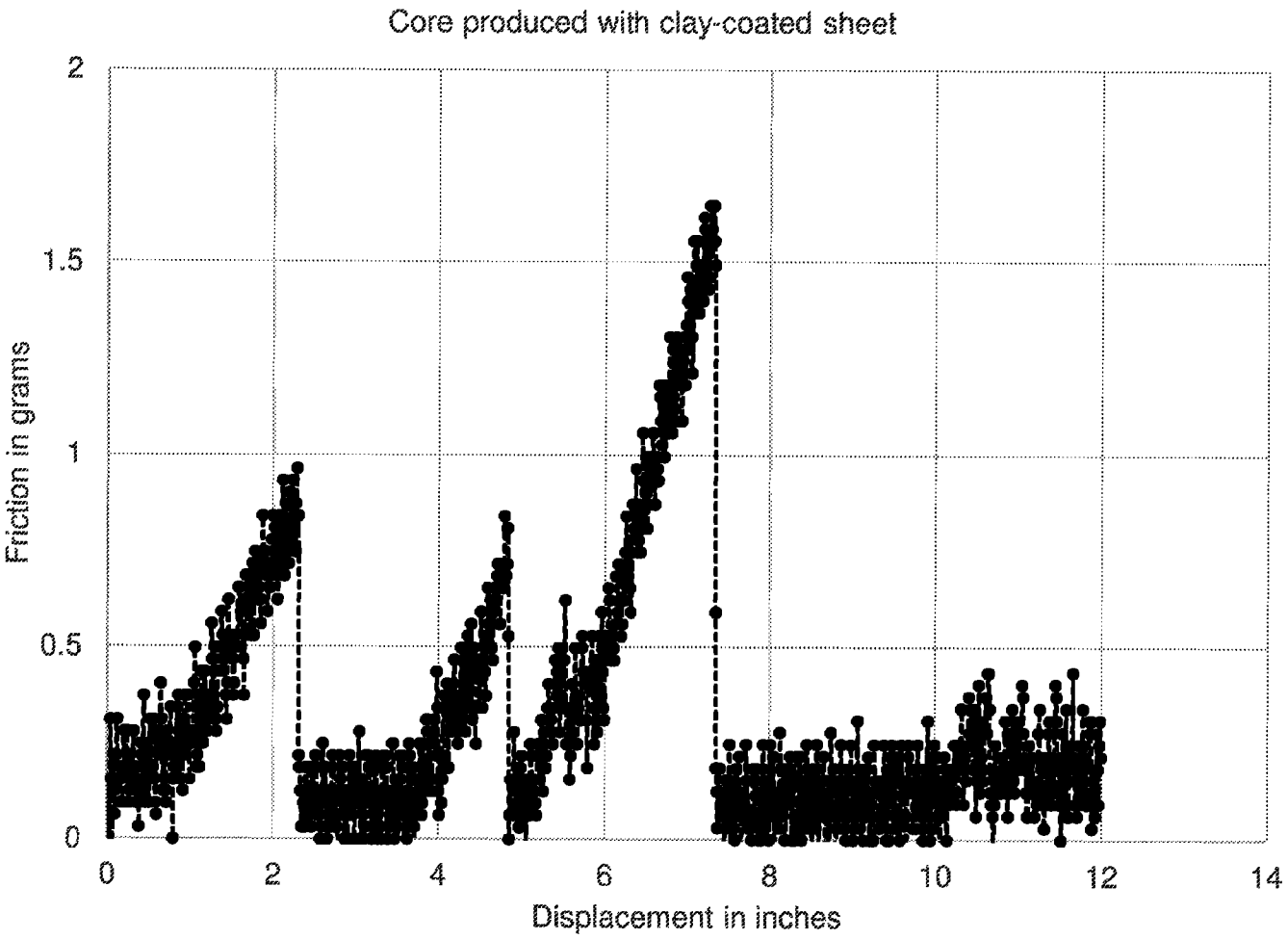
Figure 7C:
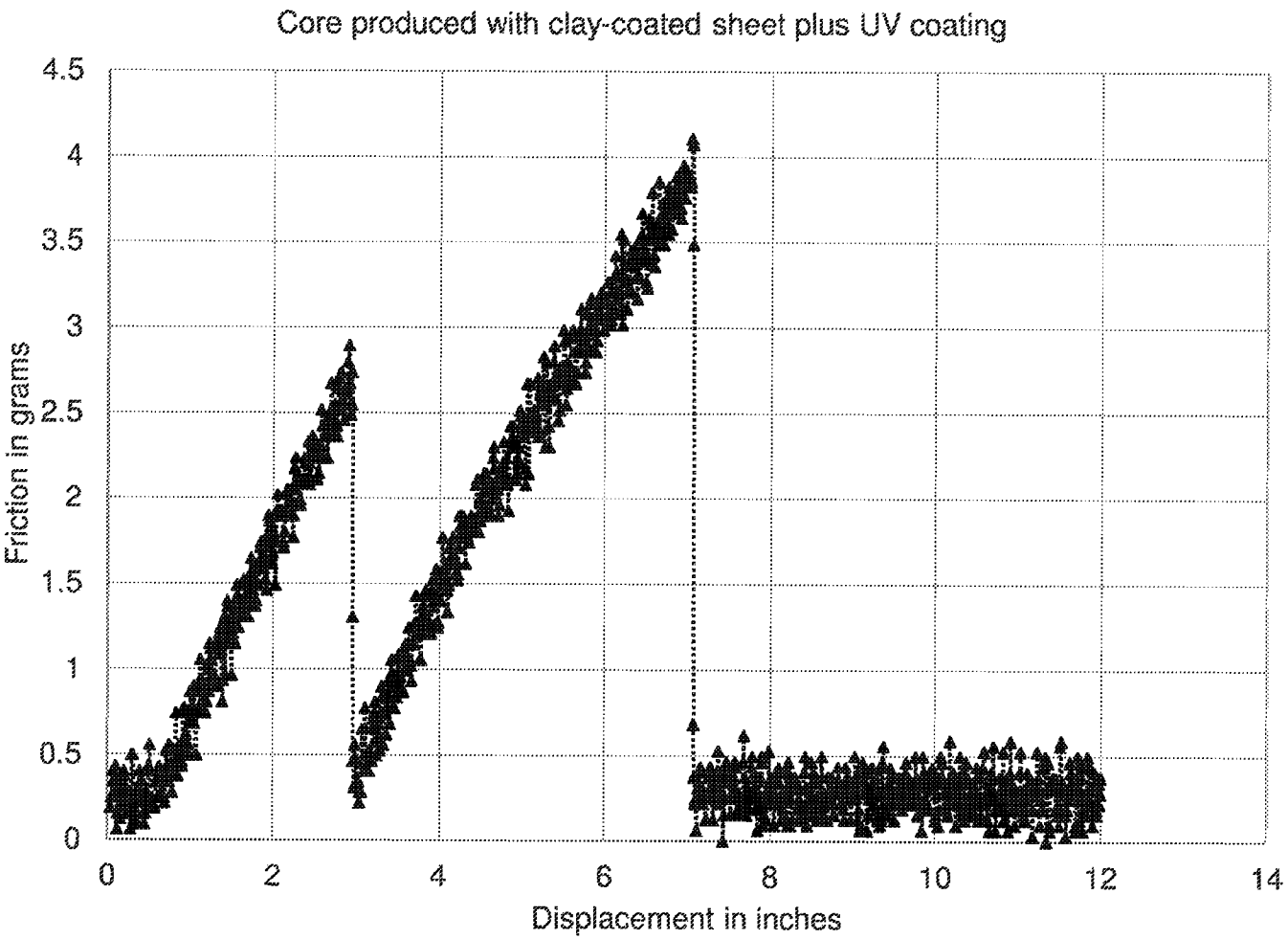

To illustrate the enhanced frictional properties in a yarn winding application using a core having a clay-coated outer ply (with and without an overcoating 80) as compared to conventional paperboard cores having a film outerply, data regarding the friction performance of cores produced with different outer surface treatments was gathered and plotted in FIGS. 7A-7C, for visual comparison.

In FIG. 7A, for example, the friction performance of a commercially available, state of the art core produced with a film outerply 30 (see FIG. 3). A spandex yarn was pulled over the surface of the core while measuring the friction at the surface using a modified horizontal plane method for conservation of friction, similar to the method in the standard test TAPPI T549. The friction force is expressed in units of grams on the y-axis of the plot (force=mass× gravity), while the displacement of the yarn over the core is presented along the x-axis in units of inches. The plot thus shows the force of friction at the surface of the core versus the displacement of the yarn over the core. As seen in FIG. 7A, as the yarn is pulled over the core surface, the friction increases, stretching the spandex yarn without achieving relative motion between the yarn and the core surface. The friction force increases to about 1.4 grams, at which point the yarn moves with respect to the core surface (the yarn "slips"), represented by a downward spike as the friction force drops to about 0.5 grams. A new segment of the yarn then contacts the surface of the core, and the friction force at the surface begins once more to increase, again reaching about 1.4 grams before slipping to 0 grams. This "hold and release" behavior is repeated multiple times during the test, resulting in the "saw tooth" frictional profile shown in FIG. 7A.

In FIG. 7B, the same friction testing protocol performed with respect to FIG. 7A is performed on a core with a clay-coated outerply 60 (see FIG. 4) according to embodiments of the invention described herein. Again, the friction between the spandex yarn and the surface of the core increases until there is slippage, resulting in a similar "hold and release" pattern reflected in the saw tooth friction profile as described above with respect to FIG. 7A. Notably, the friction force that is achievable using the clay-coated outerply 60 is commensurate with that achieved in conventional applications using a film outerply (FIG. 7A), which is counter-intuitive considering conventional knowledge of clay-coated paper as filling in imperfections in paper and providing an extremely smooth and slippery texture, rather than providing a frictionally enhanced surface. Thus, the inventors have discovered that the use of a clay-coated outerply, as described herein, provides the same frictional characteristics formerly achieved using film, while eliminating or at least reducing the drawbacks associated with film layers, as discussed above.

Furthermore, according to still other embodiments described below, the friction performance of a core produced with a combination of a clay-coated outerply and an ultraviolet (UV) coating is shown in FIG. 7C under the same friction testing protocol as in FIGS. 7A and 7B. In this case, the spandex yarn again undergoes the "saw tooth" pattern of "hold and release noted with respect to FIGS. 7A and 7B; however, notably, the friction force magnitude is almost twice the magnitude of the examples of FIGS. 7A and 7B reaching friction force levels of about 2.9-4 grams at the peaks of friction force.

Embodiments of a method for making a paperboard core configured to receive a yarn, such as an elastomeric yarn, that is wound onto the core as described above are also provided. According to embodiments of the method, an outer ply may be disposed adjacent to at least one inner ply, where the outer ply comprises clay-coated paper. As described above, the outer ply is configured to provide direct frictional engagement of the core with the yarn, such that the yarn is windable on the core via direct contact between the clay-coated outer ply and the yarn. For example, the outer ply may be disposed adjacent to the at least one inner ply via spirally winding of the outer ply onto the at least one inner ply.

In some cases, an adhesive layer may be applied between the at least one inner ply and the outer ply. An ink layer may also be applied to an outer surface of the outer ply. In addition or alternatively, an overcoating may be applied to an outer surface of the outer ply, as described above. The overcoating may be configured to act as a barrier against chemicals from the yarn passing into the core when the yarn is wound onto the core, in some cases. In other cases, the overcoating may be configured to enhance the frictional engagement of the core with the yarn.

Accordingly, embodiments of a paperboard core are described above that are configured to receive a yarn wound thereon, such as an elastomeric yarn that relies on friction for proper winding of the yarn onto the core. Embodiments of the core include a clay-coated paper outer ply, where the outer ply is configured to provide direct frictional engagement of the core with the yarn, such that the yarn is windable on the core via direct contact between the clay-coated outer ply and the yarn (e.g., without the necessity of applying a film layer to the core to enhance the frictional properties of the core). The core may include a layer of adhesive between the at least one inner ply and the outer ply, as described above, and in some cases an overcoating may be applied to an outer surface of the outer ply, such as to protect the core from chemicals found on or in the yarn, to increase the frictional engagement of the yarn with the core, or to improve the appearance of printing on the core, as described above.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A paperboard core configured to receive a yarn wound thereon, wherein the core comprises a clay-coated paper outer ply, wherein the outer ply is configured to provide direct frictional engagement of the core with the yarn, such that the yarn is windable on the core via direct contact between the clay-coated outer ply and the yarn.

2. The core of claim 1 further comprising a layer of adhesive between at least one inner ply and the outer ply.

3. The core of claim 1, wherein the outer ply comprises Precipitated Calcium Carbonate (PCC), china clay, latex, or any combination thereof.

4. The core of claim 1 further comprising an overcoating applied to an outer surface of the outer ply.

5. A paperboard core configured to receive a yarn wound thereon, wherein the core comprises:

at least one inner ply; and an outer ply disposed adjacent to the at least one inner ply, wherein the outer ply comprises clay-coated paper, wherein the outer ply is configured to provide direct frictional engagement of the core with the yarn, such that the yarn is windable on the core.

6. The core of claim 5, wherein the yarn is an elastomeric yarn.

7. The core of claim 5 further comprising an ink layer printed on an outer surface of the outer ply.

8. The core of claim 5, wherein the outer ply is spirally wound onto the at least one inner ply.

9. The core of claim 5 further comprising an overcoating applied to an outer surface of the outer ply.

10. The core of claim 9, wherein the overcoating is configured to act as a barrier against chemicals from the yarn passing into the core when the yarn is wound onto the core.

11. The core of claim 9, wherein the overcoating is configured to enhance the frictional engagement of the core with the yarn.

12. The core of claim 5 further comprising a layer of adhesive between the at least one inner ply and the outer ply.

13. The core of claim 5, wherein the outer ply comprises Precipitated Calcium Carbonate (PCC), china clay, latex, or any combination thereof.

14. A method of making a paperboard core configured to receive a yarn wound thereon, the method comprising disposing an outer ply adjacent to at least one inner ply, wherein the outer ply comprises clay-coated paper, wherein the outer ply is configured to provide direct frictional engagement of the core with the yarn, such that the yarn is windable on the core via direct contact between the clay-coated outer ply and the yarn.

15. The method of claim 14, wherein disposing the outer ply adjacent to the at least one inner ply comprises spirally winding the outer ply onto the at least one inner ply.

16. The method of claim 14 further comprising applying an adhesive layer between the at least one inner ply and the outer ply.

17. The method of claim 14 further comprising applying an overcoating to an outer surface of the outer ply.

18. The method of claim 17, wherein the overcoating is configured to act as a barrier against chemicals from the yarn passing into the core when the yarn is wound onto the core.

19. The method of claim 17, wherein the overcoating is configured to enhance the frictional engagement of the core with the yarn.

20. The method of claim 14 further comprising applying an ink layer to an outer surface of the outer ply.

* * * * *